US010650989B2

(12) United States Patent
Wu

(10) Patent No.: US 10,650,989 B2
(45) Date of Patent: May 12, 2020

(54) WATERPROOF ASSEMBLY FOR KEYBOARD SWITCH, KEYBOARD AND ELECTRONIC APPARATUS

(71) Applicant: DONGGUAN CITY KAIHUA ELECTRONICS CO., LTD, Guangdong (CN)

(72) Inventor: FuXi Wu, Guangdong (CN)

( * ) Notice: Subject to any disclaimer, the term of this patent is extended or adjusted under 35 U.S.C. 154(b) by 0 days.

(21) Appl. No.: 16/205,123

(22) Filed: Nov. 29, 2018

(65) Prior Publication Data

US 2019/0096608 A1 Mar. 28, 2019

Related U.S. Application Data

(63) Continuation of application No. PCT/CN2017/083578, filed on May 9, 2017.

(30) Foreign Application Priority Data

May 30, 2016 (CN) ..... 2016 1 0375789

(51) Int. Cl.
*H01H 13/06* (2006.01)
*H01H 13/86* (2006.01)
*H01H 3/62* (2006.01)

(52) U.S. Cl.
CPC ..... *H01H 13/86* (2013.01); *H01H 3/62* (2013.01); *H01H 13/06* (2013.01); *H01H 2223/002* (2013.01)

(58) Field of Classification Search
CPC .... H01H 13/06; H01H 9/04; H01H 2223/002; H01H 2009/048; H01H 13/70; H01H 13/063; H01H 9/041; H01H 9/047
See application file for complete search history.

(56) References Cited

U.S. PATENT DOCUMENTS 4,339,634 A * 7/1982 Weber ..... H01H 13/06 200/302.2
4,839,483 A * 6/1989 Doyle ..... H01H 1/585 200/275

(Continued)

FOREIGN PATENT DOCUMENTS

CN 201348963 11/2009
CN 102562806 7/2012

(Continued)

OTHER PUBLICATIONS

"International Search Report (Form PCT/ISA/210)", dated Jul. 28, 2017, with English translation thereof, pp. 1-6.

(Continued)

*Primary Examiner* — Ahmed M Saeed
(74) *Attorney, Agent, or Firm* — Jie Yang; ZANIP

(57) ABSTRACT

A waterproof assembly is adapted for a keyboard switch. The water proof assembly includes a body element, a water proof cover, a sliding channel, and a pushing rod. The body element defines a plunger guiding groove and a conductive member accommodating groove. The waterproof cover covers the conductive member accommodating groove. The sliding channel is defined between the conductive member accommodating groove and the waterproof cover, and is communicated with the plunger guiding groove and the conductive member accommodating groove. The pushing rod is mounted inside the sliding channel to control a conductive member of the keyboard switch to be turned on or turned off.

18 Claims, 3 Drawing Sheets

(56) References Cited

U.S. PATENT DOCUMENTS

| | | | | |
|---|---|---|---|---|
| 5,260,532 | A * | 11/1993 | Tinder | H01H 9/04 200/292 |
| 5,300,742 | A * | 4/1994 | Huang | H01H 13/70 200/302.1 |
| 6,467,683 | B2 | 10/2002 | Jun | |
| 7,282,657 | B2 * | 10/2007 | Wimmer | B29C 45/16 200/302.1 |
| 7,420,136 | B2 * | 9/2008 | Goetzl | H01H 13/06 200/302.2 |
| 8,748,766 | B2 * | 6/2014 | Han | H01H 13/06 200/302.1 |
| 9,646,786 | B1 | 5/2017 | Feng | |
| 2002/0063149 | A1 | 5/2002 | Jun | |
| 2006/0077777 | A1 * | 4/2006 | Fried | G11B 31/02 369/30.85 |
| 2011/0005908 | A1 * | 1/2011 | Lin | H01H 13/063 200/302.2 |
| 2017/0148594 | A1 | 5/2017 | Feng | |

FOREIGN PATENT DOCUMENTS

| | | |
|---|---|---|
| CN | 203339029 | 12/2013 |
| CN | 103745885 | 4/2014 |
| CN | 204390951 | 6/2015 |
| CN | 204464134 | 7/2015 |
| CN | 204991570 | 1/2016 |
| CN | 105355496 | 2/2016 |
| CN | 205828231 | 12/2016 |
| JP | 2017098219 | 6/2017 |
| WO | 2016124088 | 8/2016 |

OTHER PUBLICATIONS

"Written Opinion (Form PCT/ISA/237)", dated Jul. 28, 2017, with English translation thereof, pp. 1-11.

* cited by examiner

WATERPROOF ASSEMBLY FOR KEYBOARD SWITCH, KEYBOARD AND ELECTRONIC APPARATUS

CROSS-REFERENCE TO RELATED APPLICATION

This application is a continuation of International Patent Application No. PCT/CN2017/083578, with an international filing date of May 9, 2017, designating the United States, now pending, which claims the priority benefits of Chinese Application No. 201610375789.8, filed on May 30, 2016. The contents of all of the aforementioned applications, including any intervening amendments thereto, are incorporated herein by reference.

BACKGROUND OF THE INVENTION

1. Field of the Invention

The present disclosure relates to keyboard switch, and more particularly, to a waterproof assembly for a keyboard switch.

2. Description of Related Art

A keyboard switch is a switching means applied and disposed on a keyboard. Primary structure of a keyboard switch includes a base, a top cover, a static plate, a movable plate driving member, a movable plate, and a driving plunger. The top cover and the base are combined to define a receiving chamber. The static plate, the movable plate, and the driving plunger are disposed inside the receiving chamber, and an end portion of the driving plunger is exposed outside the receiving chamber. The driving plunger is moved up and down by pressing and operating the driving plunger, the movable plate driving member is pushed by the driving plunger, and the movable plate driving member acts on the movable plate, thereby making the movable plate and the static plate contact or detach from each other.

In the course of using a conventional keyboard switch, exterior water often permeates to the movable plate driving member along a gap between the driving plunger and the base, and adheres to the movable plate driving member, the static plate, and the movable plate, which brings about short circuit issue.

SUMMARY

To solve the aforementioned technical problem, objectives of embodiments of the present disclosure are to provide a waterproof assembly for keyboard switch with waterproof function.

The waterproof assembly for keyboard switch includes a body element, a waterproof cover, a sliding channel, and a pushing rod. The body element defines a plunger guiding groove and a conductive member accommodating groove. The waterproof cover covers the conductive member accommodating groove. The sliding channel is defined between the conductive member accommodating groove and the waterproof cover, and is communicated with the plunger guiding groove and the conductive member accommodating groove. The pushing rod is mounted inside the sliding channel to control a conductive member of the keyboard switch to be turned on or turned off.

In one embodiment of the present invention, an oil storage groove is defined to be communicated with the sliding channel.

In one embodiment of the present invention, the waterproof assembly for keyboard switch further includes a gasket. The gasket is arranged between the body element and the waterproof cover. The gasket is used to enhance compactness of a junction between the conductive member accommodating groove and the waterproof cover, thereby improving waterproof effect.

In one embodiment of the present invention, the gasket is a waterproof rubber gasket.

In one embodiment of the present invention, a convex protuberance is formed around a peripheral edge of the conductive member accommodating groove, and a positioning slot matching the protuberance is defined in the waterproof cover. The protuberance and the positioning slot are tightly engaged to improve water resistance.

In one embodiment of the present invention, the conductive member includes a movable plate and a static plate of the keyboard switch.

In one embodiment of the present invention, a waterproof colloid is coated at a junction between the body element and the waterproof cover. The waterproof colloid is applied to build a firm connection between the body element and the waterproof cover, and at the same time, to get water resistance.

In another embodiment of the present invention, an ultrasonic welding layer is provided at a junction between the body element and the waterproof cover. The ultrasonic welding layer is applied to seal the junction between the body element and the waterproof cover, so as to achieve a better waterproof effect.

In one embodiment of the present invention, the conductive member includes a receiving terminal and an emitting terminal disposed opposite to each other.

In one embodiment of the present invention, the sliding channel is communicated with the conductive member accommodating groove. A first sliding groove is defined in communication with the conductive member accommodating groove. A second sliding groove matching the first sliding groove is defined in the waterproof cover. The first sliding groove cooperates with the second sliding groove to constitute the sliding channel.

Another embodiment of the present invention provides a keyboard including a plurality of keyboard switches in an array. Each of the keyboard switches includes a waterproof assembly. The waterproof assembly includes a body element, a waterproof cover, a sliding channel, and a pushing rod. The body element defines a plunger guiding groove and a conductive member accommodating groove. The waterproof cover covers the conductive member accommodating groove. The sliding channel is defined between the conductive member accommodating groove and the waterproof cover, and is communicated with the plunger guiding groove and the conductive member accommodating groove. The pushing rod is mounted inside the sliding channel to control a conductive member of the keyboard switch to be turned on or turned off.

Another embodiment of the present invention provides an electronic apparatus including at least one keyboard with a plurality of keyboard switches in an array. Each of the keyboard switches includes a waterproof assembly. The waterproof assembly includes a body element, a waterproof cover, a sliding channel, and a pushing rod. The body element defines a plunger guiding groove and a conductive member accommodating groove. The waterproof cover covers the conductive member accommodating groove. The sliding channel is defined between the conductive member accommodating groove and the waterproof cover, and is communicated with the plunger guiding groove and the conductive member accommodating groove. The pushing rod is mounted inside the sliding channel to control a conductive member of the keyboard switch to be turned on or turned off.

Effective results of the embodiment of the present disclosure are listed below. In the waterproof assembly for keyboard switch of the present invention, the body element can be applied for a base of the keyboard switch. The plunger guiding groove is used to accommodate a switch plunger of the keyboard switch. The conductive member accommodating groove is used to dispose a conductive member of the keyboard switch. The sliding groove is defined on the conductive member accommodating groove or the waterproof cover, and the sliding groove is communicated with the plunger guiding groove and the conductive member accommodating groove. The pushing rod is mounted inside of the sliding channel so as to control the conductive member to be turned on and off. The waterproof cover is covered over the conductive member accommodating groove, to prevent exterior water falling into the conductive member accommodating groove. In order to prevent the exterior water falling into the conductive member accommodating groove down from the pushing rod, the sliding channel is provided to tightly cooperate with the pushing rod to achieve water resistance.

The above illustration is an overview of an embodiment of the present disclosure, and at least one embodiment is exemplarily described with reference to pictures in corresponding attached drawings for further detail illustration of the embodiments.

DETAILED DESCRIPTION OF THE EMBODIMENTS

To make the objective, functions, technical solutions and advantages of the present disclosure clearer, and to analysis distinguishing features and spirit of the present disclosure, the present disclosure will be further detailed with reference to specific embodiments thereof and the attached drawings.

First Embodiment

Figure 1:
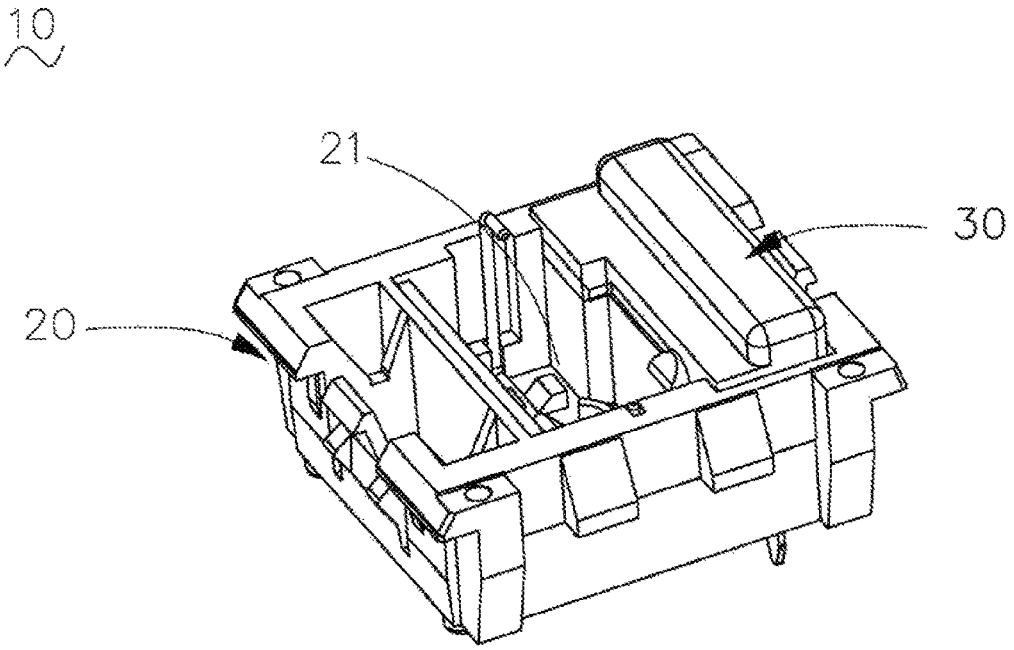
FIG. 1 is a schematic view of a waterproof assembly for keyboard switch in a first embodiment of the present disclosure.
Figure 2:
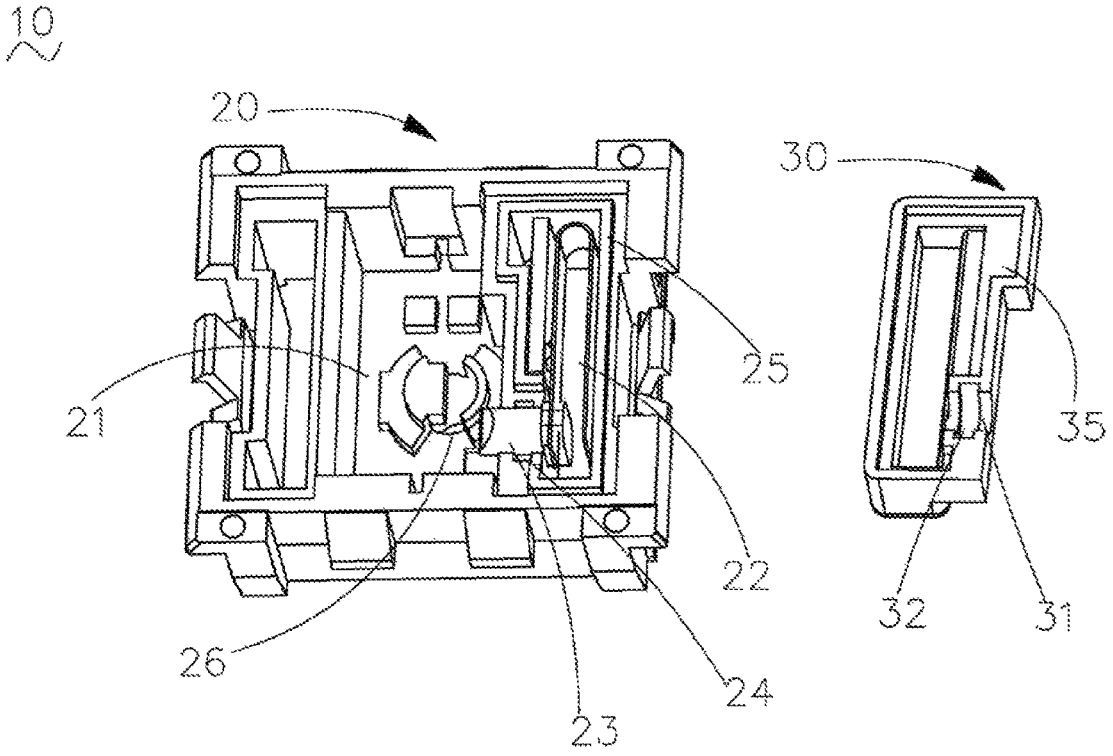
FIG. 2 is a decomposition diagram of the waterproof assembly for keyboard switch in FIG. 1.

Please referring to FIG. 1 and to FIG. 2, a waterproof assembly 10 adapted for a keyboard switch is provided.

The waterproof assembly 10 includes a body element 20, a waterproof cover 30, and a pushing rod 80. The concrete structure is illustrated as follows.

The body element 20 defines a plunger guiding groove 21 and a conductive member accommodating groove 22. The conductive member accommodating groove 22 is adapted to accommodate a conductive member of the keyboard switch, and is communicated with a first sliding groove 23. The first sliding groove 23 is communicated with the plunger guiding groove 21 and the conductive member accommodating groove 22. The first sliding groove 23 is communicated with a first oil storage groove 24. A convex protuberance 25 is formed around a peripheral edge of the conductive member accommodating groove 22. A water outlet 26 communicating with the plunger guiding groove 21 is defined at a bottom portion of the plunger guiding groove 21. In detail, one water outlet or plural water outlets may be arranged.

The waterproof cover 30 is mounted on the body element 20 and covers the conductive member accommodating groove 22. A sliding channel 40 is defined between the waterproof cover 30 and the conductive member accommodating groove 22. A second sliding groove 31 matching the first sliding groove 23 is defined in the waterproof cover 30. A second oil storage groove 32 matching the first oil storage groove 24 is defined communicating the second sliding groove 31. The first sliding groove 23 cooperates with the second sliding groove 31 to constitute the aforementioned sliding channel 40. The first oil storage groove 24 combines with the second oil storage groove 32 to constitute a waterproof oil storage tank 41 circling around outside of the sliding channel 40. A positioning slot 35 matching the protuberance 25 is defined in the waterproof cover 30.

The pushing rod 80 is disposed inside the sliding channel 40, so as to control the conductive member of the keyboard switch to be turned on and turned off. In present embodiment, the conductive member includes a movable plate 90 and a static plate of the keyboard switch. In an alternative embodiment, the conductive member may include a receiving terminal and an emitting terminal disposed opposite to each other.

Moreover, in order to further improve waterproof performance between the body element 20 and the waterproof cover 30, in present embodiment, an ultrasonic welding layer is arranged at a junction between the body element 20 and the waterproof cover 30. In an alternative embodiment, it is applicable that a waterproof colloid is coated at the junction between the body element 20 and the waterproof cover 30.

Figure 3:
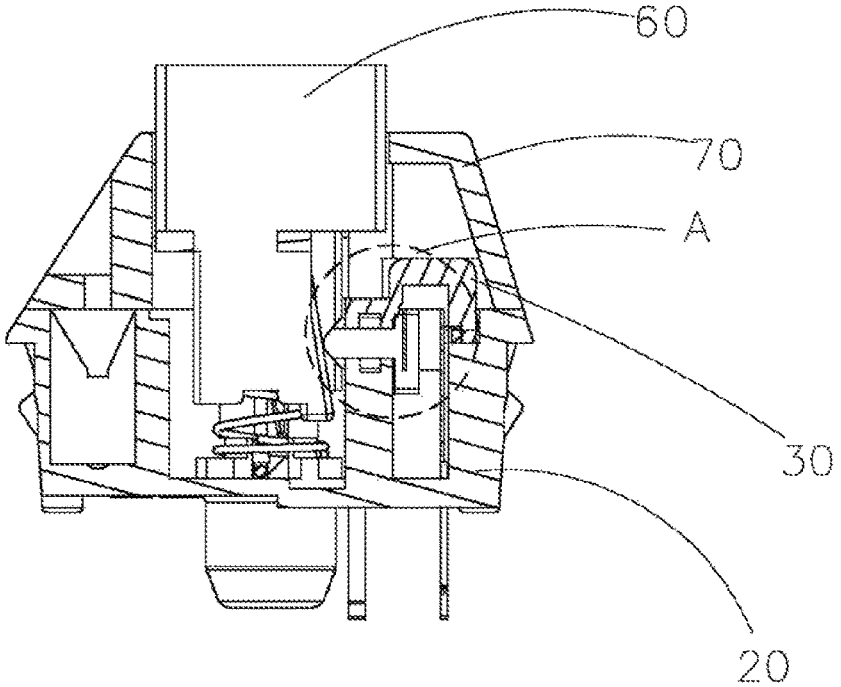
FIG. 3 is a reference diagram in application of the waterproof assembly for keyboard switch in FIG. 1.
Figure 4:
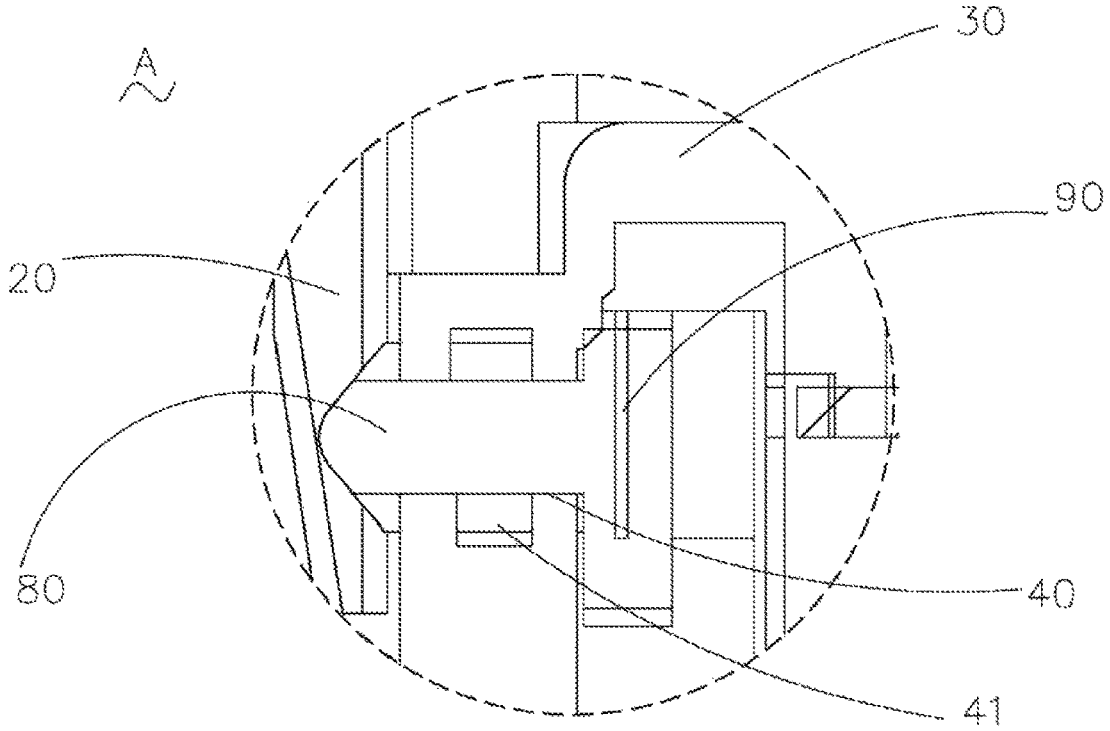
FIG. 4 is an enlarged diagram of region (A) shown in FIG. 3.

Referring to FIG. 3 and FIG. 4, the body element 20 can be used as a base of the keyboard switch. A top cover 70 is mounted on the body element 20 and overlays the waterproof cover 30. The plunger guiding groove 21 is used to receive a switch plunger 60 of the keyboard switch. The conductive member accommodating groove 22 is applied to receive the movable plate 90 and the static plate of the keyboard switch, and the pushing rod 80 of the keyboard switch is mounted in the sliding channel 40, and is capable of sticking into the conductive member accommodating groove 22. One end portion of the pushing rod 80 is restricted in the conductive member accommodating groove 22, and the other portion thereof can reciprocate along the sliding channel 40, thereby the switch plunger 60 of the keyboard switch can interact with and push the pushing rod 80 during operation, thereby triggering the movable plate 90 and the static plate. The waterproof cover 30 covers the conductive member accommodating groove 22, so as to prevent exterior water falling into the conductive member accommodating groove 22. The sliding channel 40 and the pushing rod 80 are tightly fitted to prevent water permeating into the conductive member accommodating groove 22 from the pushing rod 80. In addition, in order to prevent the exterior water from permeating into the conductive member accommodating groove 22 by the pushing rod 80, the waterproof oil storage tank 41 circling around the sliding channel 40 is set around the peripheral edge of the sliding channel 40, and the waterproof oil storage tank 41 is filled with waterproof oil and tightly seals with the pushing rod 80 to provide a waterproof function. The protuberance 25 is tightly squeezed in the positioning slot 35 to enhance waterproof effect. The water outlet 26 is set to guiding water flowing into the plunger guiding groove 21 out from the body element 20. The ultrasonic welding layer can seal the junction between the body element 20 and waterproof cover 30, thereby achieving a favorable water resistance. The waterproof colloid is adopted to build a firm connection between the body element 20 and the waterproof cover 30, and at the same time, to achieve water proof effect.

Second Embodiment

Figure 5:
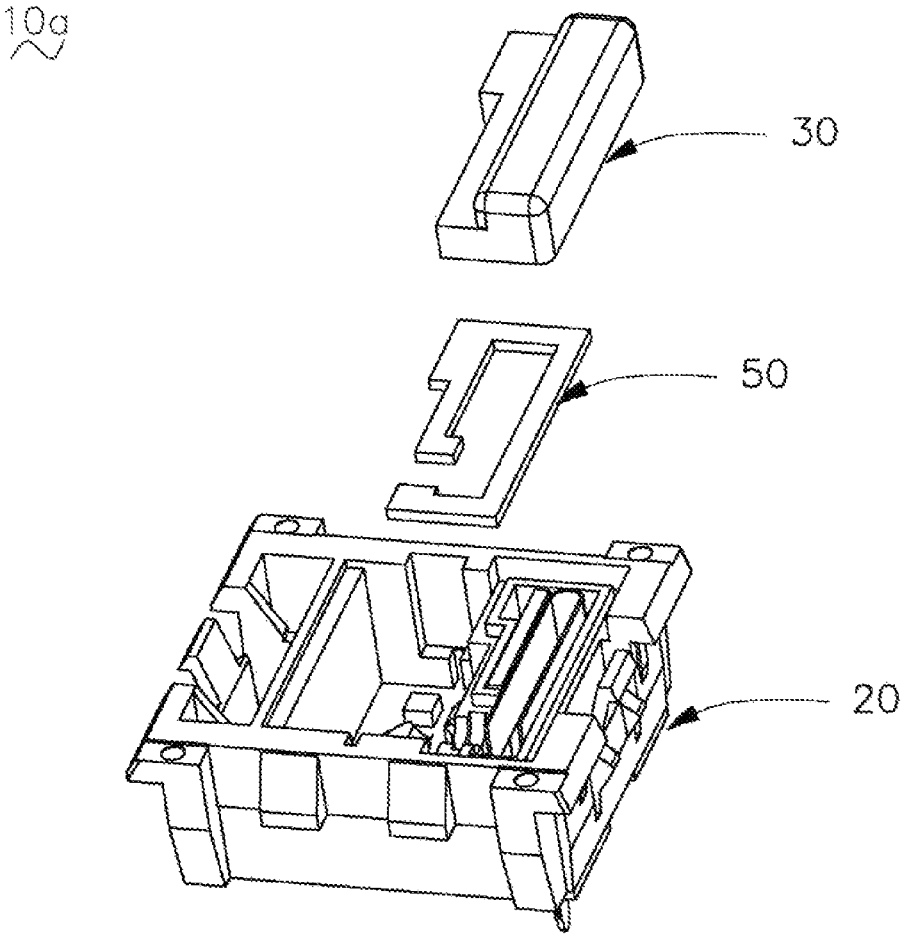
FIG. 5 is a decomposition diagram of a waterproof assembly for keyboard switch in a second embodiment of the present disclosure.

Referring to FIG. 5, the present invention provides an alternative waterproof assembly 10*a* adapted for keyboard switch.

The distinguishing features between the first embodiment and the second embodiment are listed as follows.

In present embodiment, the waterproof assembly 10*a* further includes a gasket 50 arranged between the conductive member accommodating groove 22 and the waterproof cover 30. The gasket 50 can be a waterproof rubber gasket. The gasket 50 is adapted to build a tight connection between the body element 20 and the waterproof cover 30, thereby improving water resistance. Other configurations are similar to corresponding structures described in the first embodiment, and effective results can be achieved as they are in the first embodiment.

Technique features of the above embodiments can have many derivable combinations. For simplicity, not all combinations of the technical features are presented. However, any combination of the technique features falls in the scope of the present disclosure without departing from spirit and principles thereof.

What described above are only the preferred embodiments of the present disclosure with specific details descriptions, and are not intended to limit the present technical disclosure. It should be noted that any modifications, equivalent replacements, and alterations made within the spirits and principles of the present technical disclosure shall be included in the scope of the present disclosure.

What is claimed is:

1. A waterproof assembly for a keyboard switch, the waterproof assembly comprising:

a body element, the body element defining a plunger guiding groove and a conductive member accommodating groove;

a waterproof cover, the waterproof cover covering the conductive member accommodating groove;

a sliding channel defined between the conductive member accommodating groove and the waterproof cover, and communicated with the plunger guiding groove and the conductive member accommodating groove; and a pushing rod, the pushing rod mounted inside the sliding channel to control a conductive member of the keyboard switch to be turned on or turned off.

2. The waterproof assembly according to claim 1, wherein an oil tank is defined to be communicated with the sliding channel.

3. The waterproof assembly according to claim 1, wherein the waterproof assembly further comprises a gasket, and the gasket is arranged between the conductive member accommodating groove and the waterproof cover.

4. The waterproof assembly according to claim 3, wherein the gasket is a waterproof rubber gasket.

5. The waterproof assembly according to claim 1, wherein a convex protuberance is formed around a peripheral edge of the conductive member accommodating groove, and a positioning slot matching the protuberance is defined in the waterproof cover.

6. The waterproof assembly according to claim 1, wherein the conductive member comprises a movable plate and a static plate of the keyboard switch.

7. The waterproof assembly according to claim 1, wherein a waterproof colloid is coated at a junction between the body element and the waterproof cover.

8. The waterproof assembly according to claim 1, wherein an ultrasonic welding layer is provided at a junction between the body element and the waterproof cover.

9. The waterproof assembly according to claim 1, wherein the conductive member comprises a receiving terminal and an emitting terminal disposed opposite to each other.

10. The waterproof assembly according to claim 1, wherein the sliding channel is communicated with the conductive member accommodating groove, a first sliding groove is defined in communication with the conductive member accommodating groove, a second sliding groove matching the first sliding groove is defined in the waterproof cover, and the first sliding groove cooperates with the second sliding groove to constitute the sliding channel.

11. A keyboard, comprising a plurality of keyboard switches in an array, each of the keyboard switches including a waterproof assembly, and the waterproof assembly including:

a body element, the body element defining a plunger guiding groove and a conductive member accommodating groove;

a waterproof cover, the waterproof cover covering the conductive member accommodating groove;

a sliding channel defined between the conductive member accommodating groove and the waterproof cover, and communicated with the plunger guiding groove and the conductive member accommodating groove; and a pushing rod, the pushing rod mounted inside the sliding channel to control a conductive member of the keyboard switch to be turned on or turned off.

12. The keyboard according to claim 11, wherein an oil tank is defined to be communicated with the sliding channel.

13. The keyboard according to claim 11, wherein the waterproof assembly further includes a gasket, and the gasket is arranged between the conductive member accommodating groove and the waterproof cover.

14. The keyboard according to claim 11, wherein a convex protuberance is formed around a peripheral edge of the conductive member accommodating groove, and a positioning slot matching the protuberance is defined in the waterproof cover.

15. The keyboard according to claim 11, wherein the sliding channel is communicated with the conductive member accommodating groove, a first sliding groove is defined in communication with the conductive member accommodating groove, a second sliding groove matching the first sliding groove is defined in the waterproof cover, and the first sliding groove cooperates with the second sliding groove to constitute the sliding channel.

16. An electronic apparatus, comprising at least one keyboard with a plurality of keyboard switches in an array, each of the keyboard switches including a waterproof assembly, and the waterproof assembly including:

a body element, the body element defining a plunger guiding groove and a conductive member accommodating groove, a waterproof cover, the waterproof cover covering the conductive member accommodating groove;

a sliding channel defined between the conductive member accommodating groove and the waterproof cover, and communicated with the plunger guiding groove and the conductive member accommodating groove; and a pushing rod, the pushing rod mounted inside the sliding channel, to control a conductive member of the keyboard switch to be turned on or turned off.

17. The electronic apparatus according to claim 16, wherein an oil tank is defined to be communicated with the sliding channel.

18. The electronic apparatus according to claim 16, wherein the waterproof assembly further includes a gasket, and the gasket is arranged between the conductive member accommodating groove and the waterproof cover.

* * * * *